US005188794A

United States Patent [19]

Daussan et al.

[11] Patent Number: 5,188,794

[45] Date of Patent: Feb. 23, 1993

[54] METHOD FOR COVERING A METALLURGICAL VESSEL WITH A PURIFYING LINING AND COMPOSITION RELATING TO SAID METHOD, AND PROTECTIVE LINING THUS OBTAINED

[75] Inventors: Jean-Charles Daussan, Metz; Gérard Daussan; André Daussan, both of Longeville-les-Metz, all of France

[73] Assignee: Daussan et Compagnie, Woippy, France

[21] Appl. No.: 613,622

[22] PCT Filed: Apr. 11, 1990

[86] PCT No.: PCT/FR90/00263

§ 371 Date: Nov. 20, 1990

§ 102(e) Date: Nov. 20, 1990

[87] PCT Pub. No.: WO90/11853

PCT Pub. Date: Oct. 18, 1990

[30] Foreign Application Priority Data

Apr. 12, 1989 [FR] France ..... 89 04822

[51] Int. Cl.[5] ..... B22D 41/02

[52] U.S. Cl. ..... 266/44; 266/280; 266/275

[58] Field of Search ..... 266/275, 280, 281, 286, 266/44

[56] References Cited

FOREIGN PATENT DOCUMENTS

| | | |
|---|---|---|
| 0082124 | 6/1983 | European Pat. Off. . |
| 966136 | 7/1957 | Fed. Rep. of Germany . |
| 1218923 | 4/1959 | Fed. Rep. of Germany . |
| 1239226 | 1/1961 | Fed. Rep. of Germany . |
| 61-33743 | 2/1986 | Japan . |
| 527024 | 10/1940 | United Kingdom . |

*Primary Examiner*—Scott Kastler

*Attorney, Agent, or Firm*—Young & Thompson

[57] ABSTRACT

There is applied on the internal wall of a metallurgical vessel a composition containing a carbonate of an alkaline-earth metal to which there has been added a certain proportion of refractory material in grains and this lining is heated in order to remove $CO_2$ and in order to obtain an oxide layer of the alkaline-earth metal of porous structure. The proportion of refractory material is sufficient to endow the lining with sufficient resistance to erosion by the molten metal which is poured into the vessel. To be used for obtaining a purifying lining having good resistance to erosion from molten metal poured into the vessel.

15 Claims, No Drawings

METHOD FOR COVERING A METALLURGICAL VESSEL WITH A PURIFYING LINING AND COMPOSITION RELATING TO SAID METHOD, AND PROTECTIVE LINING THUS OBTAINED

The present invention relates to a method for covering a metallurgical vessel such as a tundish or casting ladle with a purifying lining.

A purifying lining is understood to mean a lining which is capable of reducing contamination of molten metal with impurities such as oxides.

In order to limit oxidation of molten metal, a current practice consists in employing means such as casting tubes interposed between the casting, ladle and the tundish and covering powders placed on the surface of the molten metal.

However, these means do not make it possible to reduce contamination of the metal bath completely.

It is already known to make use of linings for metallurgical vessels, in particular for tundishes, which are obtained by spraying a composition in the form of aqueous slurry containing refractory particles such as $SiO_2$, $Al_2O_3$, MgO or a mixture of these latter, and an organic or inorganic binder. These particles sinter under the action of heat of the molten metal as this latter is poured into the vessel, thus ensuring cohesion of the lining. However, linings of this type do not have a purifying function in regard to the molten metal and some of them even have a contaminating effect.

There is also known a lining obtained by application of burnt dolomite consisting essentially of CaO and of MgO in the form of grains mixed with a binder such as a thermosetting resin, for example.

Linings obtained by application of raw dolomite or calcium carbonate are also known.

After application of these linings, these latter are subjected to heating which decomposes the carbonate and/or the binder. There thus remains a porous layer consisting essentially of CaO and/or of MgO having a density of less than 1.

Linings of this type have purifying properties with respect to molten metal. These properties are mainly based on the avidity of CaO for oxides which contaminate the metal such as $Al_2O_3$, FeO, $Fe_2O_3$, while producing compounds which are more readily fusible than the constituents and which migrate towards the slag.

However, these linings are subject to a disadvantage in that they have very low mechanical strength, with the result that they do not resist the abrasion caused by the molten metal.

In order, to overcome these disadvantages, the present applicants have performed the following two tests:

In a first test, the applicants applied within a tundish an aqueous mixture comprising approximately 98% raw dolomite and 2% sodium silicate as binder.

After spraying, the lining was burnt right through up to approximately 900° C. so as to release $CO_2$ from the dolomite.

The burnt lining thus formed had a porous structure whose mechanical strength was insufficient to withstand the abrasion produced by the molten metal.

In a second test, the present applicants poured the aforementioned mixture into the space located between the internal wall of the tundish and a wall forming a mold.

After drying at 180° C., it was found that the lining had no internal mechanical strength and was destroyed at the time of withdrawing the wall which forms a mold, with the result that this mode of operation is of no interest from an industrial standpoint.

The present applicants have continued their researches in order to discover an industrially acceptable solution which makes it possible to obtain a purifying lining from raw dolomite or calcite.

The aim of the present invention is precisely to propose a method and a composition for the formation of a purifying lining of this type, and a lining obtained by application of this method.

The invention is thus directed to a method and a composition for lining the internal wall of a metallurgical vessel so as to form a purifying lining having a base of at least one oxide of an alkaline-earth metal.

In accordance with the invention, this method is characterized by the following steps :

- there is applied on the internal wall of the vessel a composition containing at least one simple or multiple carbonate of alkaline-earth metal to which there has been added a certain proportion of granular refractory material, and
- this composition is heated in order to eliminate $CO_2$ as well as any constituent water and/or hydration water and in order to obtain a layer of alkaline-earth metal oxide or oxides having a porous structure, the proportion of refractory material being sufficient to endow the lining with sufficient resistance to erosion by the molten metal which is poured into the vessel.

The composition may also contain a certain proportion either of alkaline-earth hydroxides or of alkaline-earth oxides which can become hydrated at the time of wetting of the composition and can sufficiently activate the lime or magnesia "in situ" at the time of preheating of said composition, again with a view to endowing the lining with sufficient strength.

The method in accordance with the invention thus makes it possible to obtain an economical purifying lining since it employs as starting product one or a number of alkaline-earth carbonates such as dolomite or calcite.

Moreover, the lining obtained has good resistance to the erosion produced by the metal which is poured into the metallurgical vessel.

Thus the lining in accordance with the invention has a double function, namely the purifying function and the function of wearing lining so that it can advantageously replace all the wearing and protection linings which have been applied up to the present time and do not have a purifying function.

The merit of the present invention lies in the surprising discovery that the addition of a certain proportion of refractory material to one or a number of simple or multiple alkaline-earth carbonates made it possible to obtain, after burning tat is to say after removal of $CO_2$, a structure having distinctly higher erosion resistance than that obtained without said refractory material.

Moreover, apart from its purifying properties which are due to the alkaline-earth oxide obtained after burning the lining obtained has a sufficiently porous structure to endow it with heat-insulating properties which enable it to limit cooling of the molten metal contained in the casting vessel.

Moreover, the lining obtained by means of the method in accordance with the invention does not strongly adhere to the permanent refractory lining on which it is applied, with the result that it can readily be detached at the end of a casting operation with a view of applying a fresh lining.

The above-mentioned composition can advantageously be sprayed in the form of an aqueous slurry with approximately 15 to 20% by weight of water.

The composition can also be poured between the internal surface of the metallurgical vessel and a wall which forms a mold.

After application, the lining is heated right through to approximately 900° C. in order to release $CO_2$ from the alkaline-earth carbonate as well as any constituent water and/or hydration water. This heating operation can be carried out by any means such as a burner, electric elements for heating by Joule effect or emission of infrared radiation.

The simple or multiple alkaline-earth carbonate employed in the composition is preferably a carbonate selected from the following compounds : raw dolomite, raw calcite and their mixtures although dolomite is preferred on account of its low cost in the raw state (uncalcined).

In order to facilitate its application, the composition employed preferably contains a binder selected from the mineral binders such as, for example: alkali silicate or alkali phosphate, organic binders such as phenolic resin, for example, hydraulic binders such as cements , for example, and their mixtures.

The refractory material added to the alkaline-earth carbonate is preferably selected from the following compounds :

calcined dolomite, lime, magnesia, chrome-magnesia, chromium oxide, zirconium silicate, silica, aluminosilicates and/or their mixtures.

The composition by weight of the main constituents is advantageously as follows :

alkaline-earth carbonate: 30 to 95%
refractory material 70 to 5%
binder: 0 to 15%.

The optimum proportions will depend on the effect which is sought. As the proportion of alkaline earth carbonate is higher, so the purifying effect will be greater.

Conversely, the resistance to erosion of the lining will be greater as the proportion of refractory material is higher.

It is an advantage to ensure, however, that the proportion of refractory material is just sufficient to endow the lining with the desired erosion resistance in order to preserve the purifying properties due to the alkaline-earth oxide which remains after release of the $CO_2$. In order to enhance the purifying properties of the lining, the elements containing calcium will be given preference in the composition.

In certain cases, the presence of the binder is not essential since an effect of setting in water already exists when it is not present.

The best results are obtained with the following composition:

60 to 80% raw dolomite
10 to 40% refractory material; and
1 to 5% binder.

The alkaline-earth carbonate can be calcium carbonate either in the pure state or associated with another carbonate such as, for example, magnesium carbonate in the form of dolomite.

Moreover, the alkaline-earth oxides mentioned by way of examples of refractory material can be replaced entirely or partly by hydroxides and/or sulfates, these latter being converted to oxides at the time of burning.

Preferably, the size of at least part of the grains of refractory material is larger than the size of the grains of alkaline-earth carbonates and/or hydroxides and/or sulfates.

In fact, the grains of carbonates, hydroxides and sulfates decompose more readily and rapidly as they are of smaller size.

Generally speaking, the particle size can be adjusted as a function of the desired result, namely the porosity which confers insulating properties and/or properties of sintering which ensure cohesion and erosion resistance.

The composition in accordance with the invention preferably contains in addition up to 20% by weight of organic and/or mineral fibers.

The composition in accordance with the invention can also contain carbonaceous material in grains.

Preferably, the composition contains in addition up to 5% by weight of a surface-active agent.

The above-mentioned composition can be applied on the bottom wall and lateral faces of a tundish by spraying or molding in one or a number of layers having a thickness of a few centimeters.

Should it be desired to accelerate the appearance of sintering at the surface of the purifying layer during its first contact with the molten steel, it will be useful to add to the mixture one or a number of fluxes such as, for example: olivine, colemanite, borocalcite (calcium borate), iron oxide, a fluoride, boric acid and its salts (borax) and their mixtures. One may thus choose a flux which migrates to the surface with the water at the time of drying, such as boric acid, for example, in order to obtain rapid sintering of the surface which comes into contact with the molten steel, and to seek less rapid or less active sintering of the purifying lining throughout its mass by means of a flux which does not migrate such as colemanite, for example.

The fineness of the grains which constitute the lining also plays a part in the sintering process and the following formulae can advantageously be employed, the percentages being given by weight:

Dolomite and/or calcite and/or hydroxides and/or sulfates: 30 to 95%, diameter of grains $<3$ mm, preferably $<1$ mm
Refractory material: 70 to 5%, diameter of grains $<5$ mm, preferably $<2$ mm
Binder: 0 to 15%
Carbon: 0 to 5%
Fluxes: 0 to 10%.

Depending on requirements, one of the following fluxes can be selected :

a readily soluble flux which is capable of migrating to the surface,
an insoluble or sparingly soluble flux,
a mixture of both types of flux in a predetermined proportion which permits a certain selective sintering at the surface and within the different thicknesses of the layer.

It is possible in addition to obtain maximum compactness of the layer by optimizing the respective particle sizes of the different constituents in known manner, for example by applying the law of Bolomey or of Furnas compactness or even by applying the rule of the triangle. It is thus possible to increase the resistance of the purifying layer to erosion by the molten metal without having to make use of any mechanical compacting process which is impossible to achieve in practice at low cost.

In the case of a lining consisting of several layers, the composition and size of the grains can vary from one layer to another as a function of the properties which are sought.

Thus if it is desired that the inner layer (namely the layer which is intended to come into contact with the molten metal) should have high resistance to erosion, this layer will contain a greater quantity of refractory material and will contain fine particles in order to promote sintering.

Conversely, it may be preferred to ensure that the outer layer which is adjacent to the permanent refractory lining sinters to a lesser degree than the inner layer so that it may be readily detached from the permanent lining on completion of the casting operation.

Similarly, it will be possible to enhance the basicity of the inner layer by means of a high calcium content in order to obtain optimum purifying properties.

A multilayer lining for protecting the internal wall of a metallurgical vessel can thus comprise:

an inner purifying wearing lining which comes into contact with the molten steel, having a base of oxide of an alkaline-earth metal (dolomite, hydroxides, sulfates, calcite, carbonates), an outer safety layer placed in position between the purifying wearing layer and the permanent lining; this layer can be either a layer which is sinterable at the temperatures involved and having a base of grains of stable refractory oxides (for example having a base of magnesia and/or silica and/or alumina and/or zircon and/or zirconia) or else, by way of alternative, an outer safety layer which is slightly or very slightly sinterable having a base of stable refractory oxides supplied with an addition of carbon (less than 35% carbon). This last layer can also play the part of a third slightly or very slightly sinterable layer which is placed between the aforementioned safety layer and the permanent lining in order to avoid any adhesion of the permanent lining, as in the case of any other partially, slightly or very slightly sinterable layer.

It is thus possible, for example, to adopt for the outer safety layer or layers the compositions indicated respectively in French patents No. 2 393 637 and 2 585 273 in the name of the present assignee.

It is also possible in the case of three layers to have a first purifying inner layer, a second slightly or very slightly sinterable or unsinterable layer, and a third sinterable or at least partially sinterable outer layer.

We claim:

1. Method for covering the internal wall of a metallurgical vessel to form a purifying lining having a base of oxide of an alkaline-earth metal, said method comprising the steps of:

applying on said internal wall a lining of composition containing at least one carbonate of alkaline-earth metal in admixture with granular oxide refractory material, said composition being capable of sintering when in contact with molten metal poured into said vessel, heating said lining in order to eliminate $CO_2$ as well as any water, thereby to obtain a layer of alkaline-earth metal oxide having a porous structure, said predetermined proportion of refractory material being sufficient to endow the lining when sintered with resistance to erosion by molten metal subsequently poured into the vessel, said composition having the following composition by weight:

alkaline-earth carbonate: 30 to 95%
oxide refractory material: 70 to 5%
binder: 0 to 15%
carbon: 0 to 5%
flux: 0 to 10%.

2. Composition for covering the internal wall of a metallurgical vessel to form a purifying lining having a base of oxide of an alkaline-earth metal, said composition containing at least one carbonate of alkaline-earth metal in admixture with granular oxide refractory material, said composition being capable of sintering when in contact with molten metal poured into said vessel, said composition being adapted to be applied on said internal wall and to be heated in order to eliminate $CO_2$ as well as any water and in order to obtain a layer of alkaline-earth metal oxide having a porous structure, said refractory material being present in a quantity sufficient to endow the lining when sintered with resistance to erosion by molten metal subsequently poured into the vessel, said composition having the following composition by weight:

alkaline-earth carbonate 30 to 95%
oxide refractory material: 70 to 5%
binder: 0 to 15%
carbon: 0 to 5%
flux: 0 to 10%

3. Composition in accordance with claim 2, wherein, said alkaline-earth carbonate is selected from the group consisting of raw dolomite, calcite and their mixtures.

4. Composition in accordance with claim 2, wherein said binder is selected from the group consisting of mineral, organic, and hydraulic binders and their mixtures.

5. Composition in accordance with claim 2 wherein, the refractory material is selected from the group consisting of:

calcined dolomite, lime, magnesia, chromemagnesia, chromium oxide, zirconium silicate, silica, aluminosilicates and their mixtures.

6. Composition in accordance with claim 2, wherein, it contains, by weight:

60 to 80% raw dolomite
10 to 40% refractory material and
1 to 5% binder.

7. Composition in accordance with claim 6 wherein, characterized in that the size of at least part of the grains of refractory material is larger than the size of the grains of alkaline-earth carbonate.

8. Composition in accordance with claim 2, which contains in addition up to 20% by weight of organic or mineral fibers or a mixture thereof.

9. Composition in accordance with claim 2, which, characterized in that it contains in addition up to 5% by weight of a surface-active agent.

10. Composition in accordance with claim 2, which contains in addition alkaline-earth hydroxide(s) or alkaline-earth oxide(s) or a mixture thereof which are capable of hydrating at the time of wetting of the composition.

11. Composition in accordance with claim 2, wherein the flux is selected from the group consisting of olivine colemanite, borocalcite (calcium borate), iron oxide, fluorides, boric acid and its salts (borax) and their mixtures.

12. Composition in accordance with claim 2 wherein the constituents have the following particle size:

carbonates of alkaline-earth metals: diameter smaller than 3 mm, refractory grains: diameter smaller than 5 mm.

13. Composition in accordance with claim 2, wherein the respective particle sizes of the constituents are chosen so as to give maximum compactness to the purifying lining.

14. Purifying lining having a base of oxide of an alkaline-earth metal for protecting the internal wall of a metallurgical vessel, produced from the composition of claim 2.

15. Lining as in claim 14, which comprises successively:

an inner layer of a purifying lining, at least one outer layer applied before the purifying lining layer, said outer layer being at least partially sinterable in contact with molten metal and having a base of stable refractory oxides.

* * * * *